US011944243B2

(12) United States Patent
Chen

(10) Patent No.: US 11,944,243 B2
(45) Date of Patent: Apr. 2, 2024

(54) PORTABLE BATHTUB

(71) Applicant: Taizhou Xiaotanglang Infant and Child Products Co., Ltd., Taizhou (CN)

(72) Inventor: Jian Chen, Taizhou (CN)

(73) Assignee: Taizhou Xiaotanglang Infant and Child Products Co., Ltd., Taizhou (CN)

( * ) Notice: Subject to any disclaimer, the term of this patent is extended or adjusted under 35 U.S.C. 154(b) by 0 days.

(21) Appl. No.: 18/346,202

(22) Filed: Jul. 1, 2023

(65) Prior Publication Data

US 2024/0016342 A1 Jan. 18, 2024

(30) Foreign Application Priority Data

Jun. 9, 2023 (CN) ..... 202321461019.7

(51) Int. Cl.
*A47K 3/024* (2006.01)

(52) U.S. Cl.
CPC ..... *A47K 3/024* (2013.01)

(58) Field of Classification Search
CPC ..... A47K 3/024; A47K 3/06; A47K 3/062; A47K 3/064; A47K 3/074; A47K 3/022; A47K 3/03; A47K 3/162; A47K 3/164; A61H 35/006
See application file for complete search history.

(56) References Cited

U.S. PATENT DOCUMENTS

| | | | | |
|---|---|---|---|---|
| 3,799,228 | A * | 3/1974 | Crawford | A47K 3/064 4/538 |
| 8,607,375 | B2 * | 12/2013 | Yeung | A47K 3/06 4/585 |
| 9,918,896 | B2 * | 3/2018 | Tsang | A61H 33/026 |
| D902,361 | S * | 11/2020 | Wu | D23/278 |
| 2003/0019028 | A1 | 1/2003 | Shimizu | |
| 2009/0223464 | A1 * | 9/2009 | Dumenil | A01K 13/001 119/676 |
| 2010/0275364 | A1 | 11/2010 | Torres et al. | |
| 2015/0020305 | A1 | 1/2015 | Knapp et al. | |
| 2022/0079390 | A1 * | 3/2022 | Pruzhansky | A47K 3/024 |

FOREIGN PATENT DOCUMENTS

| | | | | |
|---|---|---|---|---|
| CN | 203591207 U | * | 5/2014 | |
| CN | 109567647 A | * | 4/2019 | A47K 3/064 |
| KR | 101331838 B1 | * | 11/2013 | |

* cited by examiner

*Primary Examiner* — Erin Deery
(74) *Attorney, Agent, or Firm* — Zhigang Ma

(57) ABSTRACT

The present disclosure discloses a portable bathtub. The portable bathtub includes a bathtub main body, at least one locking member and a supporting member. The bathtub main body includes a framework and an accommodating portion formed by downwards extension of the framework. The supporting member is configured to detachably connect the bathtub main body through the at least one locking member.

19 Claims, 10 Drawing Sheets

PORTABLE BATHTUB

CROSS-REFERENCE TO RELATED APPLICATIONS

The application claims priority of Chinese patent application CN2023214610197, filed on 2023 Jun. 9, which is incorporated herein by reference in its entireties.

TECHNICAL FIELD

The present disclosure relates to the technical field of bathtubs, and particularly, to a portable bathtub.

BACKGROUND

As main equipment in a bathroom, bathtubs are usually used when people choose to take a hip bath. However, for babies, as they do not know how to take a shower, bathtubs have become essential equipment for bathing. Among various bathtubs, foldable bathtubs are particularly favored due to their portability, small occupied area, and the like.

However, due to non-removable supporting legs of an existing bathtub, the supporting legs occupy a large space during storage of the bathtub by a user, which brings lots of troubles and inconvenience to users.

To this end, this invention provides a portable bathtub that can effectively solve the above problems and has a simple structure, is provided with supporting legs convenient to mount and remove, and is convenient to use and store.

SUMMARY

In order to overcome the shortcomings of the prior art, the present disclosure provides a portable bathtub, which has a simple structure, is provided with supporting legs convenient to mount and remove, and is convenient to use and store.

The technical solution adopted by the present disclosure to solve the technical problem is as follows: a portable bathtub including a bathtub main body comprising a framework and an accommodating portion formed by downwards extension of the framework; at least one locking member; and a supporting member, and the supporting member configured to detachably connect the bathtub main body through the at least one locking member.

As the improvement of the present disclosure, the supporting member includes supporting legs, the locking member is arranged at connecting ends of the supporting legs, the framework is provided with plugging holes and locking holes communicated to the plugging holes, the locking members is configured to move between locked positions and released positions; the connecting ends of the supporting legs are able to be detachably plugged into the plugging holes; and when the locking members move to the locked positions, the locking members are plugged into the locking holes.

As the improvement of the present disclosure, each locking member includes a mounting shell, a locking block, and an elastic member; a movement space is arranged in the mounting shell; a mounting slot is formed in the connecting end of each supporting leg; the mounting shell is plugged into the mounting slot; the locking block is slidably arranged in the movement space; one end of the elastic member resists against the locking block; and the other end of the elastic member resists against an inner wall of the mounting slot or an inner wall of the movement space, so that the locking block is plugged into the locking hole.

As the improvement of the present disclosure, the mounting shell is provided with an opening communicated to the movement space; a first limiting step is arranged on an inner wall of the movement space; the locking block is provided with a plugging portion and a sliding portion; a first limiting block is arranged between the plugging portion and the sliding portion; the sliding portion slides in the movement space; the plugging portion passes through the movement space along the opening; and when the locking block is plugged to the locking hole, the first limiting block resists against the first limiting step.

As the improvement of the present disclosure, a second limiting block is arranged on an outer surface of the mounting shell; a second limiting step is arranged on the inner wall of the mounting slot; and when the mounting shell is plugged to the mounting slot, the second limiting block resists against the second limiting step.

As the improvement of the present disclosure, a guide slope is arranged on one side of the second limiting block facing away from the mounting shell; and the guide slope is used for allowing an edge of the second limiting step to slide along the guide slope.

As the improvement of the present disclosure, each supporting leg is further provided with an open slot communicated to the mounting slot; and the open slot is used for allowing a finger of a user to be placed and removing the mounting shell.

As the improvement of the present disclosure, the portable bathtub further including actuators, wherein the actuators are slidably arranged on one side of the framework close to the locking holes; the actuators resist against the locking blocks; and the actuators are allowed to be moved by the user to actuate the locking blocks to be removed from the locking holes.

As the improvement of the present disclosure, each actuator includes a sliding block, a press block, and a resisting block; the sliding block and the resisting block are both connected to the press block; the framework is provided with a sliding rail; the sliding block is slidably arranged in the sliding rail; the press block is allowed to be pressed by the user for actuation; and the resisting block is used for resisting against the locking block to actuate the locking block to be removed from the locking hole.

As the improvement of the present disclosure, third limiting blocks are convexly arranged on two sides of the sliding block; a third limiting step is arranged at an edge of the sliding rail; and the third limiting blocks resist against the third limiting step.

As the improvement of the present disclosure, a supporting rod is arranged between free ends of the two supporting legs on one side of the bathtub main body, and the supporting rod is used for being in contact with a supporting plane.

As the improvement of the present disclosure, friction textures are formed on a surface of the press block.

As the improvement of the present disclosure, the supporting legs are provided with first reinforcing ribs.

As the improvement of the present disclosure, the portable bathtub further including a temperature measuring device, wherein the temperature measuring device is arranged on the framework; and the temperature measuring device is used for measuring a water temperature in the accommodating portion.

As the improvement of the present disclosure, the framework is rigid, and a lower surface of the framework is provided with a second reinforcing rib.

As the improvement of the present disclosure, a bayonet is further arranged on an edge of the framework, and the bayonet is used for allowing a shower head to be plugged for use.

As the improvement of the present disclosure, the framework is further provided with a hanging hole, and the hanging hole is used for allowing a hanger to pass.

As the improvement of the present disclosure, the accommodating portion includes a side wall and a bottom wall; an upper edge of the side wall is connected to a lower edge of the framework; a lower edge of the side wall is connected to a peripheral edge of the bottom wall; at least part of the side wall is elastic; and at least part of the bottom wall is rigid.

As the improvement of the present disclosure, the side wall includes an upper connecting portion, a deformation portion, and a lower connecting portion; the deformation portion is arranged between the upper connecting portion and the lower connecting portion; the upper connecting portion is connected to the framework; the lower connecting portion is connected to the bottom wall; and the side wall is folded along the deformation portion to reduce a height of the portable bathtub.

As the improvement of the present disclosure, the portable bathtub further includes a drainage valve, wherein the bottom wall is provided with a drainage hole; and the drainage valve is plugged into the drainage hole.

As the improvement of the present disclosure, the bottom wall is convexly provided with supporting steps and a supporting ring; the supporting steps are arranged at two side edges of the bottom wall; and the supporting ring is arranged in the middle of the bottom wall.

Beneficial effects: based on the above structural setting, in a used state, the connecting ends of the supporting legs are plugged into the plugging holes, and the locking members are moved to the locking positions. The locking members are plugged into the locking holes, which can effectively fixedly connect the supporting legs to the framework and improve the stability of a product. In a transported or stored state, the locking members are moved to the released positions. At this time, the locking members are removed from the locking holes, so that the user can separate the supporting legs from the framework, and it is convenient for the user to transport or store the product, improving the portability of the product.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
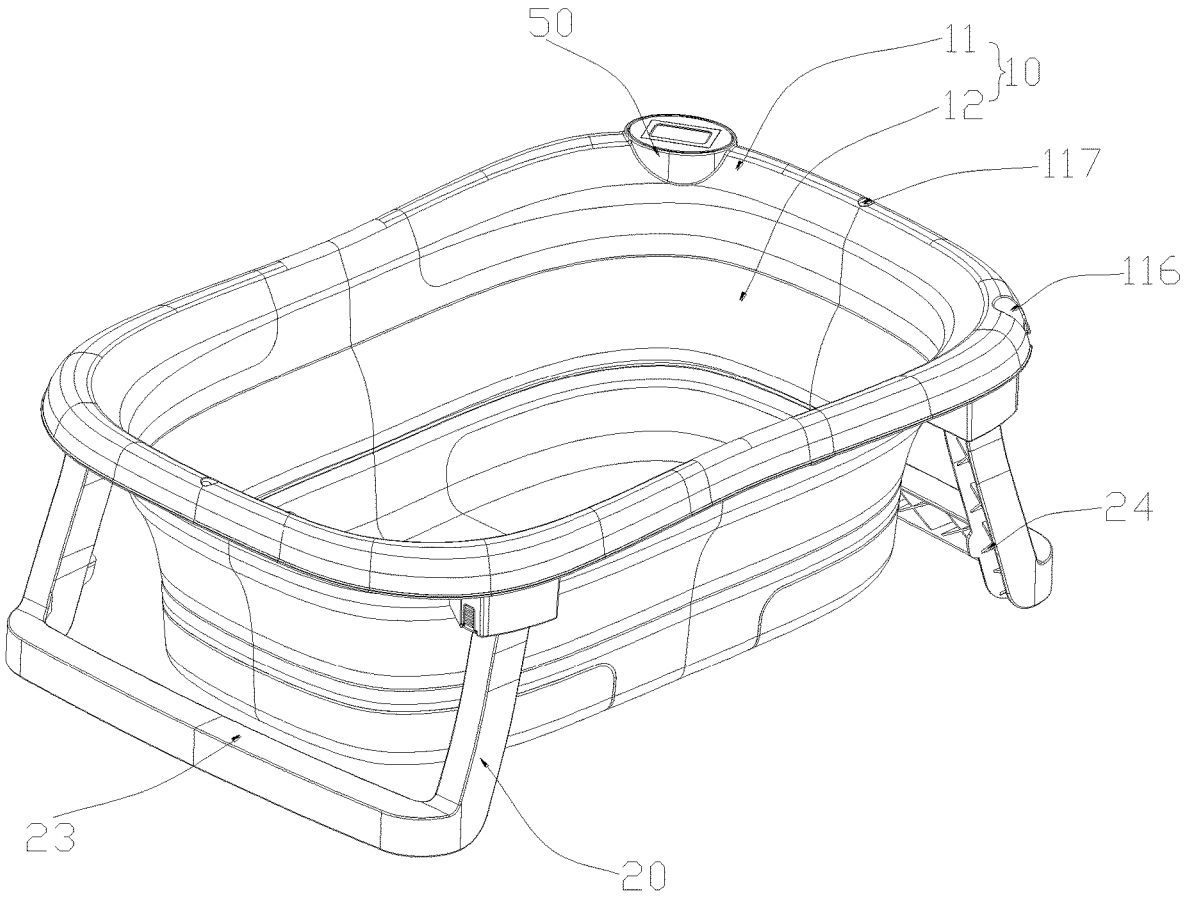
FIG. 1 is a schematic diagram of an entire structure in one angle of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Referring to FIG. 1 to FIG. 3 and FIG. 5, a portable bathtub includes a bathtub main body 10 and supporting legs 20.

The bathtub main body 10 includes a framework 11 and an accommodating portion 12 formed by downwards extension of the framework 11, and the framework 11 is provided with plugging holes 111 and locking holes 112 communicated to the plugging holes 111.

Locking members 30 are arranged at connecting ends of the supporting legs 20; the locking members 30 move between locked positions and released positions; and the connecting ends of the supporting legs 20 are detachably plugged into the plugging holes 111. When the locking members 30 move to the locked positions, the locking members 30 are plugged into the locking holes 112.

Based on the above structural setting, in a used state, the connecting ends of the supporting legs 20 are plugged into the plugging holes 111, and the locking members 30 are moved to the locking positions. The locking members 30 are plugged into the locking holes 112, which can effectively fixedly connect the supporting legs 20 to the framework and improve the stability of a product. In a transported or stored state, the locking members 30 are moved to the released positions. At this time, the locking members 30 are removed from the locking holes 112, so that the user can separate the supporting legs 20 from the framework, and it is convenient for the user to transport or store the product, improving the portability of the product.

Figure 8:
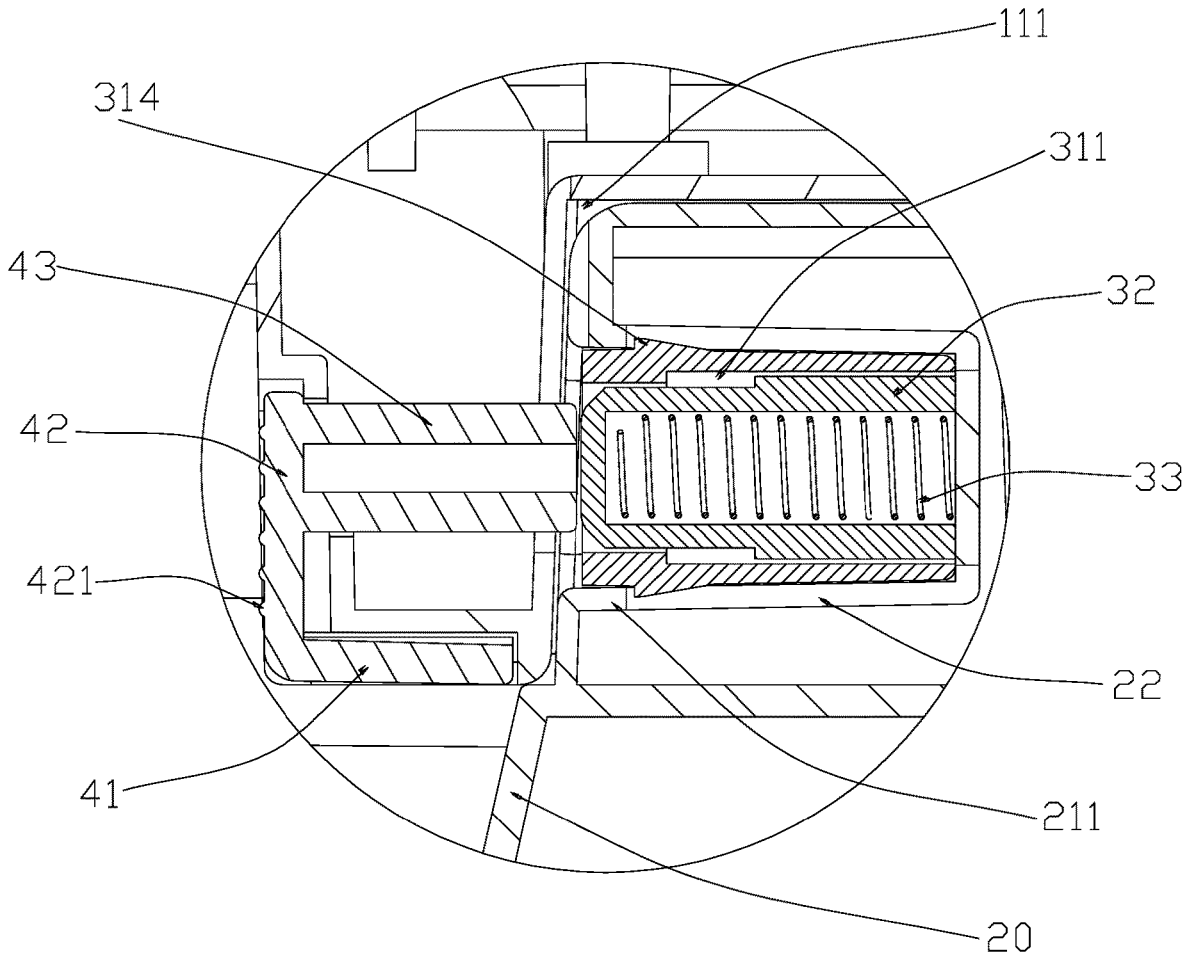
FIG. 8 is an enlarged diagram of circle C in FIG. 7.
Figure 9:
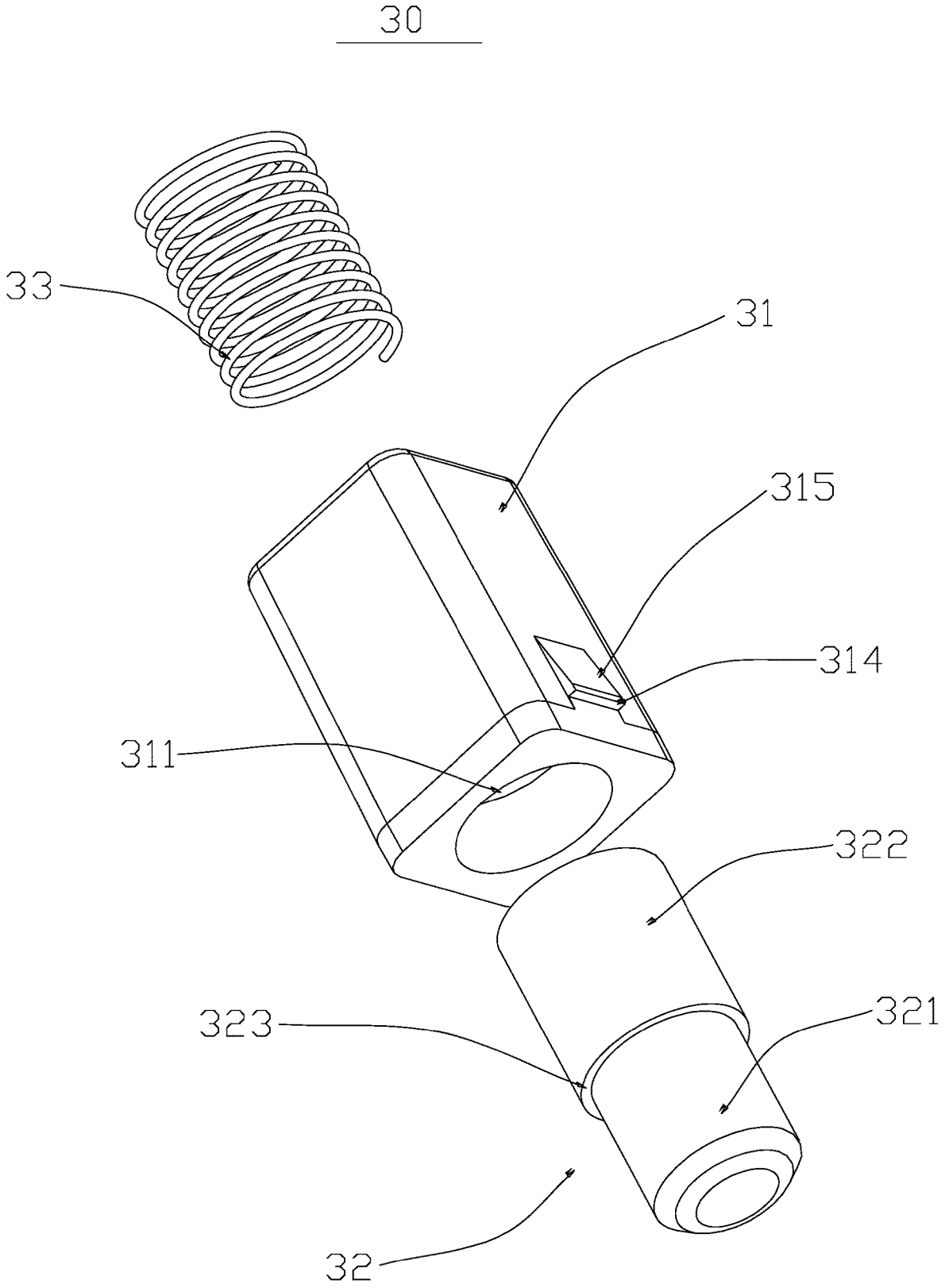
FIG. 9 is a schematic diagram of an exploded structure of a locking member of the present disclosure.
Figure 10:
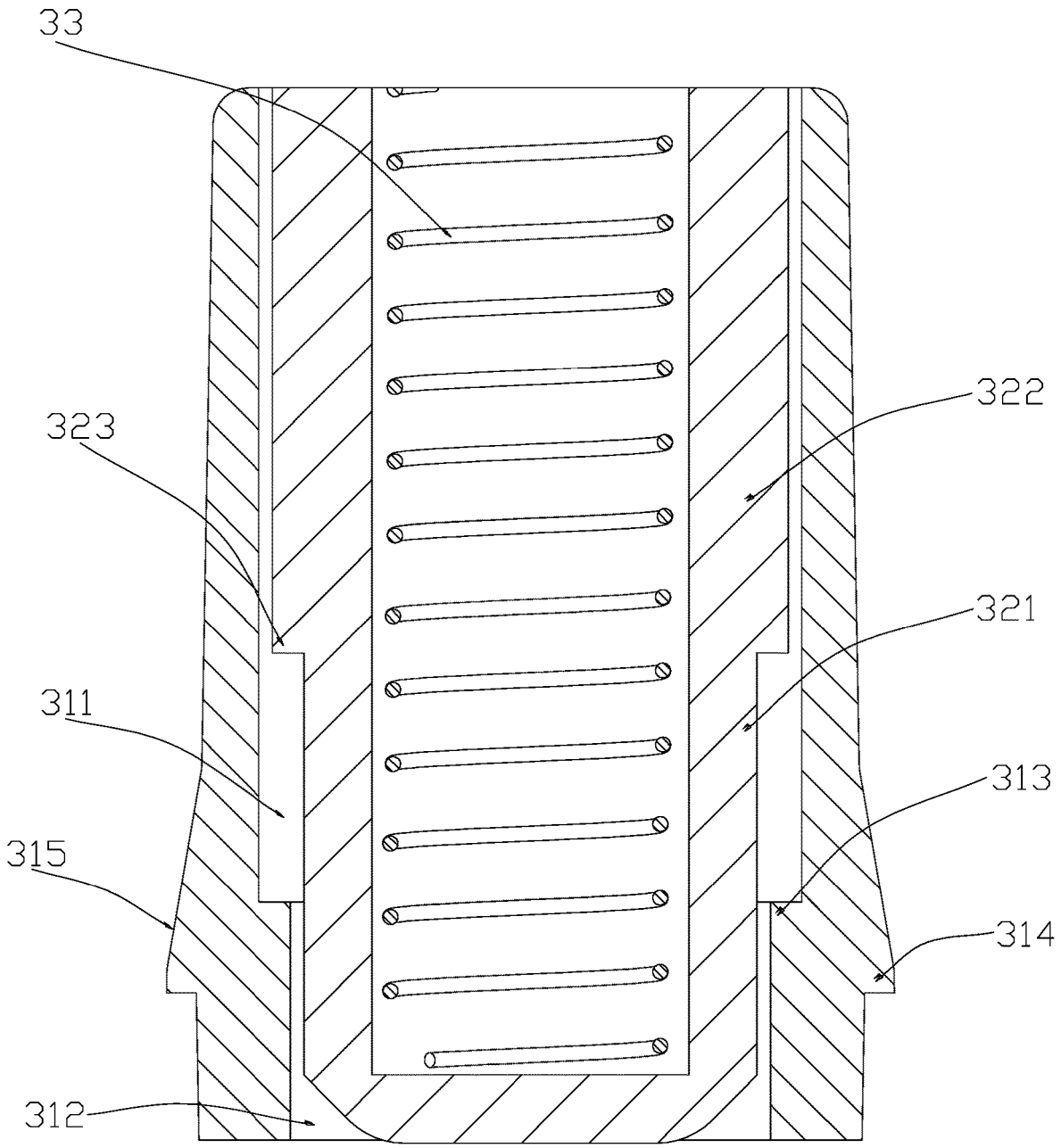
FIG. 10 is a schematic diagram of a sectional structure of a locking member of the present disclosure.

Referring to FIG. 8 to FIG. 10, in this embodiment, each locking member 30 includes a mounting shell 31, a locking block 32, and an elastic member 33. A movement space 311 is arranged in the mounting shell 31. A mounting slot 21 is formed in the connecting end of each supporting leg 20. The mounting shell 31 is plugged into the mounting slot 21. The locking block 32 is slidably arranged in the movement space 311. One end of the elastic member 33 resists against the locking block 32. The other end of the elastic member 33 resists against an inner wall of the mounting slot 21 or an inner wall of the movement space 311, so that the locking block 32 is plugged into the locking hole 112. Based on the above structural setting, the mounting shells 31 are plugged into the mounting slots 21, so that it can be convenient for the user to separately produce the complicated locking members 30. The mounting slots 21 are formed in the supporting legs 20, and the locking members 30 are subsequently plugged into the mounting slots 21, so that the production efficiency can be improved, and the yield of production can be increased. Due to the arrangement of the elastic members 33, two ends of the elastic members 33 respectively resist against the locking blocks 32 and the inner walls of the mounting slots 21 or the inner walls of the movement spaces 311. The locking blocks 32 press the elastic members 33, and the elastic members 33 deform. At this time, the locking members 30 are located at the released positions, so that it is convenient for the user to mount and remove the supporting legs 20. The elastic members 33 are reset, and the locking blocks 32 are actuated to move. At this time, the locking members 30 are located at the locked positions. When the locking blocks 32 are plugged into the locking holes 112, the supporting legs 20 can be stably connected to the framework, so that the stability of the product is improved.

Referring to FIG. 8 to FIG. 10, in this embodiment, the mounting shell 31 is provided with an opening 312 communicated to the movement space 311. A first limiting step 313 is arranged on an inner wall of the movement space 311. The locking block 32 is provided with a plugging portion 321 and a sliding portion 322. A first limiting block 323 is arranged between the plugging portion 321 and the sliding portion 322. The sliding portion 322 slides in the movement space 311. The plugging portion 321 passes through the movement space 311 along the opening 312. When the locking block 32 is plugged to the locking hole 112, the first limiting block 323 resists against the first limiting step 313. Based on the above structural setting, the first limiting block 323 is convexly arranged on a surface of the locking block 32. The first limiting step 313 is arranged at a position, close to the opening 312, on the inner wall of the movement space 311, so that the locking block 32 can be prevented from popping up along the opening 312 when the elastic member 33 is reset, and the stability of the product is ensured. Only the plugging portion 321 of the locking block 32 passes through the opening 312 and is plugged to the locking hole, to lock the supporting leg 20.

Referring to FIG. 8 to FIG. 10, in this embodiment, a second limiting block 314 is arranged on an outer surface of the mounting shell 31. A second limiting step 211 is arranged on the inner wall of the mounting slot 21. When the mounting shell 31 is plugged to the mounting slot 21, the second limiting block 314 resists against the second limiting step 211. Based on the above structural setting, when the mounting shell 31 is mounted in the mounting slot 21, the second limiting block 314 resists against the second limiting step 211, which can effectively limit the mounting shell 31 and stably connect the mounting shell 31 to the mounting slot 21, so that the stability of the product is improved.

Referring to FIG. 8 to FIG. 10, in this embodiment, a guide slope 315 is arranged on one side of the second limiting block 314 facing away from the mounting shell 31. The guide slope 315 is used for allowing an edge of the second limiting step 211 to slide along the guide slope 315. Based on the above structural setting, the guide slope 315 can enable the user to plug the mounting shell 31 into the mounting slot 21 smoothly. The mounting shell 31 is pressed, and the guide slope 315 slides along the edge of the second limiting step 211, which facilitates mounting and improves the assembling efficiency of the product.

Referring to FIG. 3 to FIG. 6, in this embodiment, each supporting leg 20 is further provided with an open slot 22 communicated to the mounting slot 21. The open slot 22 is used for allowing a finger of the user to be placed and removing the mounting shell 31. Based on the above structural setting, due to the open slot 22 communicated to the mounting slot 21, when the mounting shell 31 is mounted in the mounting slot 21, part of the mounting shell 31 is exposed through the open slot 22, so that the user can press this part. For example, preferably, the guide slope 315 is partially exposed, so that the user can place the finger in the open slot 22 and press part of the guide slope 315 to remove the second limiting block 314 from the second limiting step 211, which facilitates the user to remove the mounting shell 31.

Referring to FIG. 3 to FIG. 6, in this embodiment, the portable bathtub further includes actuators 40. The actuators 40 are slidably arranged on one side of the framework 11 close to the locking holes 112. The actuators 40 resist against the locking blocks 32. The actuators 40 are allowed to be moved by the user to actuate the locking blocks 32 to be removed from the locking holes 112. Based on the above structural setting, due to the arrangement of the actuators 40, the user can be allowed to press or move the locking blocks 32, thereby achieving connection or separation of the locking blocks 32 and the locking holes 112, which facilitates control, so that the supporting legs 20 can be mounted or removed more conveniently, and operations are facilitated.

Referring to FIG. 3 to FIG. 6, in this embodiment, each actuator 40 includes a sliding block 41, a press block 42, and a resisting block 43. The sliding block 41 and the resisting block 43 are both connected to the press block 42. The framework 11 is provided with a sliding rail 113. The sliding block 41 is slidably arranged in the sliding rail 113. The press block 42 is allowed to be pressed by the user for actuation. The resisting block 43 is used for resisting against the locking block 32 to actuate the locking block 32 to be removed from the locking hole 112. Based on the above structural setting, during use, the sliding block 41 can slide in the sliding rail 113 in a reciprocating manner. The press block 42 can facilitate pressing to actuate the actuators 40, and the resisting block 43 can be in effective contact with the locking block 32 to actuate the locking block 32 to move, so that locking block 32 is located at the locked position or the released position, which further facilitates the user to mount and remove the supporting legs 20.

Referring to FIG. 3 to FIG. 6, in this embodiment, third limiting blocks 411 are convexly arranged on two sides of the sliding block 41. A third limiting step 114 is arranged at an edge of the sliding rail 113. The third limiting blocks 411 resist against the third limiting step 114. Based on the above structural setting, the third limiting blocks 411 are arranged at an edge of the sliding block 41, and the third limiting step 114 is arranged at the edge of the sliding rail 113, which can limit a sliding position of the sliding block 41 to prevent the sliding block 41 from sliding out of the sliding rail 113 and ensure the stability of the product.

Figure 2:
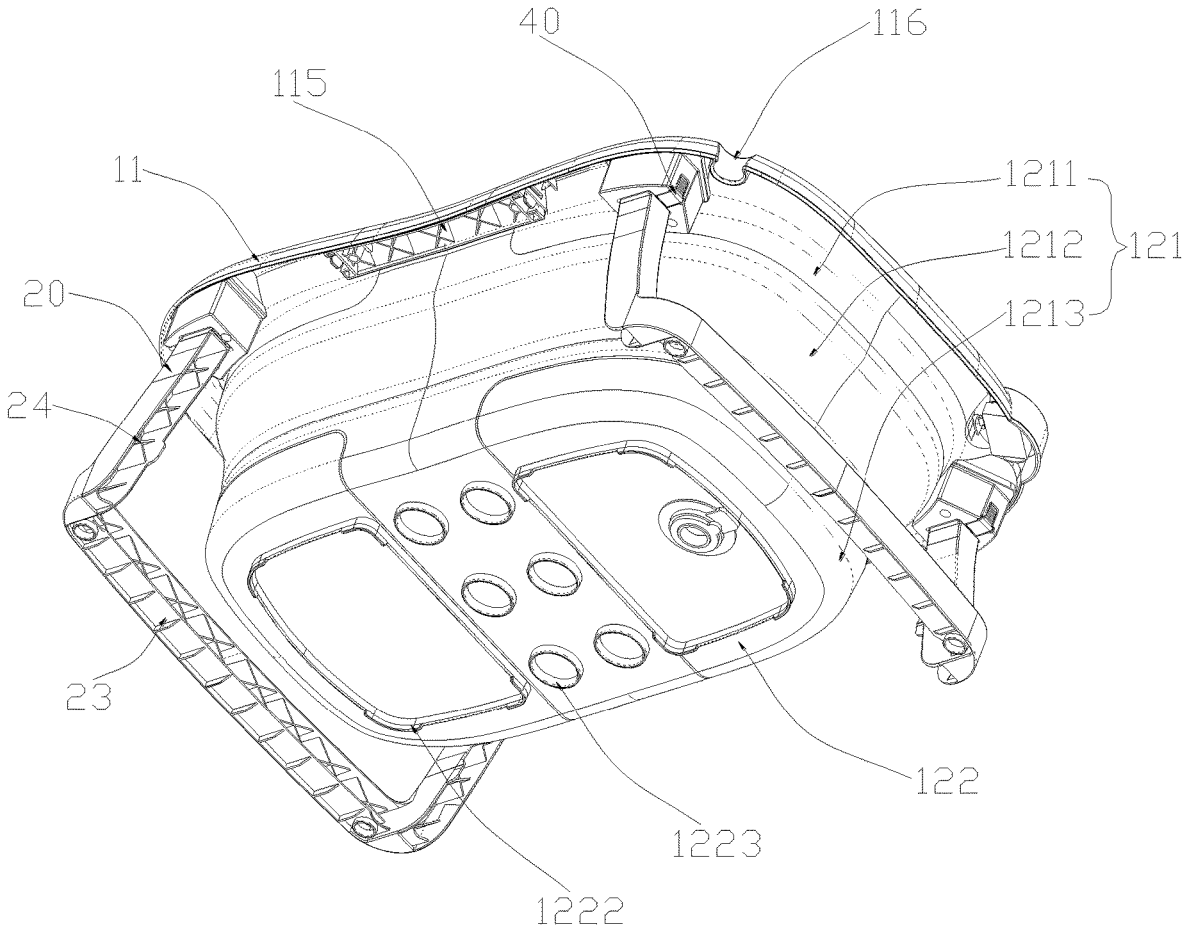
FIG. 2 is a schematic diagram of an entire structure in another angle of the present disclosure.

Referring to FIG. 1 to FIG. 2, in this embodiment, a supporting rod 23 is arranged between free ends of the two supporting legs 20 on one side of the bathtub main body 10, and the supporting rod 23 is used for being in contact with a supporting plane. Based on the above structural setting, the supporting rod 23 is arranged between the two supporting legs 20, which can enlarge a contact area between the supporting legs 20 and the ground, reduce pressure intensity between the supporting legs and the supporting plane such as the ground, and prevent the supporting legs 20 or the supporting plane from being damaged. Furthermore, the contact area can also be enlarged; the friction force can be increased; and the stability of placement of the product is improved.

Referring to FIG. 3 to FIG. 6, in this embodiment, friction textures 421 are formed on a surface of the press block 42. Based on the above structural setting, during use, the friction textures 421 can increase a friction force between the finger of the user and the press block 42, which facilitates the user to actuate the press block 42.

Referring to FIG. 1 to FIG. 2, in this embodiment, the supporting legs 20 are provided with first reinforcing ribs 24. Based on the above structural setting, the first reinforcing ribs 24 can improve the strength of the supporting legs 20. The service life of the product is prolonged without adding many weights.

Referring to FIG. 1 to FIG. 2, in this embodiment, the portable bathtub further includes a temperature measuring device 50. The temperature measuring device 50 is arranged on the framework 11. The temperature measuring device 50 is used for measuring a water temperature in the accommodating portion 12. Based on the above structural setting, by the arrangement of the temperature measuring device 50, the user can be allowed to learn about the temperature of the water in the accommodating portion in real time, thus adjusting the water temperature, so that a better use experience is brought to the user. Particularly for babies with tender skin, a proper bathtub water temperature is an important factor that ensures the health and safety of kids.

Referring to FIG. 1 to FIG. 2, in this embodiment, the framework 11 is rigid, and a lower surface of the framework 11 is provided with a second reinforcing rib 115. Based on the above structural setting, the second reinforcing rib 115 can improve the strength of the framework. The service life of the product is prolonged without adding many weights. Furthermore, the rigid framework can improve the strength of the product. It is easier for the user to grab the product when the user moves the product, to facilitate use.

Referring to FIG. 1 to FIG. 2, in this embodiment, a bayonet 116 is further arranged on an edge of the framework 11, and the bayonet 116 is used for allowing a shower head to be plugged for use. Based on the above structural setting, during use, the user can plug a handle portion of the shower head into the bayonet 116, so that the shower head can be effectively fixed, and both hands of the user can be relieved; babies are bathed more conveniently; and the portable bathtub is convenient to use. Preferably, the bayonet 116 has a wide top and a narrow bottom, so that the shower head can be better fixed by virtue of the gravity of the shower head.

Referring to FIG. 1 to FIG. 2, in this embodiment, the framework 11 is further provided with a hanging hole 117, and the hanging hole 117 is used for allowing a hanger to pass. Based on the setting of the above structure, during use, the user can thread a hook, a nail, a rope, or the like into the hanging hole 117, so as to conveniently hang the bathtub on the hanger, which facilitates storage.

Referring to FIG. 1 to FIG. 2, in this embodiment, the accommodating portion 12 includes a side wall 121 and a bottom wall 122. An upper edge of the side wall 121 is connected to a lower edge of the framework 11. A lower edge of the side wall 121 is connected to a peripheral edge of the bottom wall 122. At least part of the side wall 121 is elastic, and at least part of the bottom wall 122 is rigid. Based on the setting of the above structure, the rigid bottom wall 122 is firmer, and is more easily placed on the supporting plane such as the ground. The elastic side wall 121 can have a certain deformation, and the side wall 121 is softer. When a baby is in contact with the side wall 121, the baby in the accommodating portion 12 feels more comfortable due to the softer touch.

Referring to FIG. 1 to FIG. 2, in this embodiment, the side wall 121 includes an upper connecting portion 1211, a deformation portion 1212, and a lower connecting portion 1213. The deformation portion 1212 is arranged between the upper connecting portion 1211 and the lower connecting portion 1213. The upper connecting portion 1211 is connected to the framework 11. The lower connecting portion 1213 is connected to the bottom wall 122. The side wall 121 can be folded along the deformation portion 1212 to reduce a height of the portable bathtub. Based on the above structural setting, to store the bathtub, the accommodating portion 12 can be folded along the deformation portion 1212, so that the bottom wall 122 is partially accommodated in the framework to reduce the height of the entire bathtub, which facilitates the user to store the product. To use the bathtub, the accommodating portion 12 is unfolded along the deformation portion 1212 to increase the volume of the accommodating portion 12, which facilitates the user to bath the baby.

Figure 3:
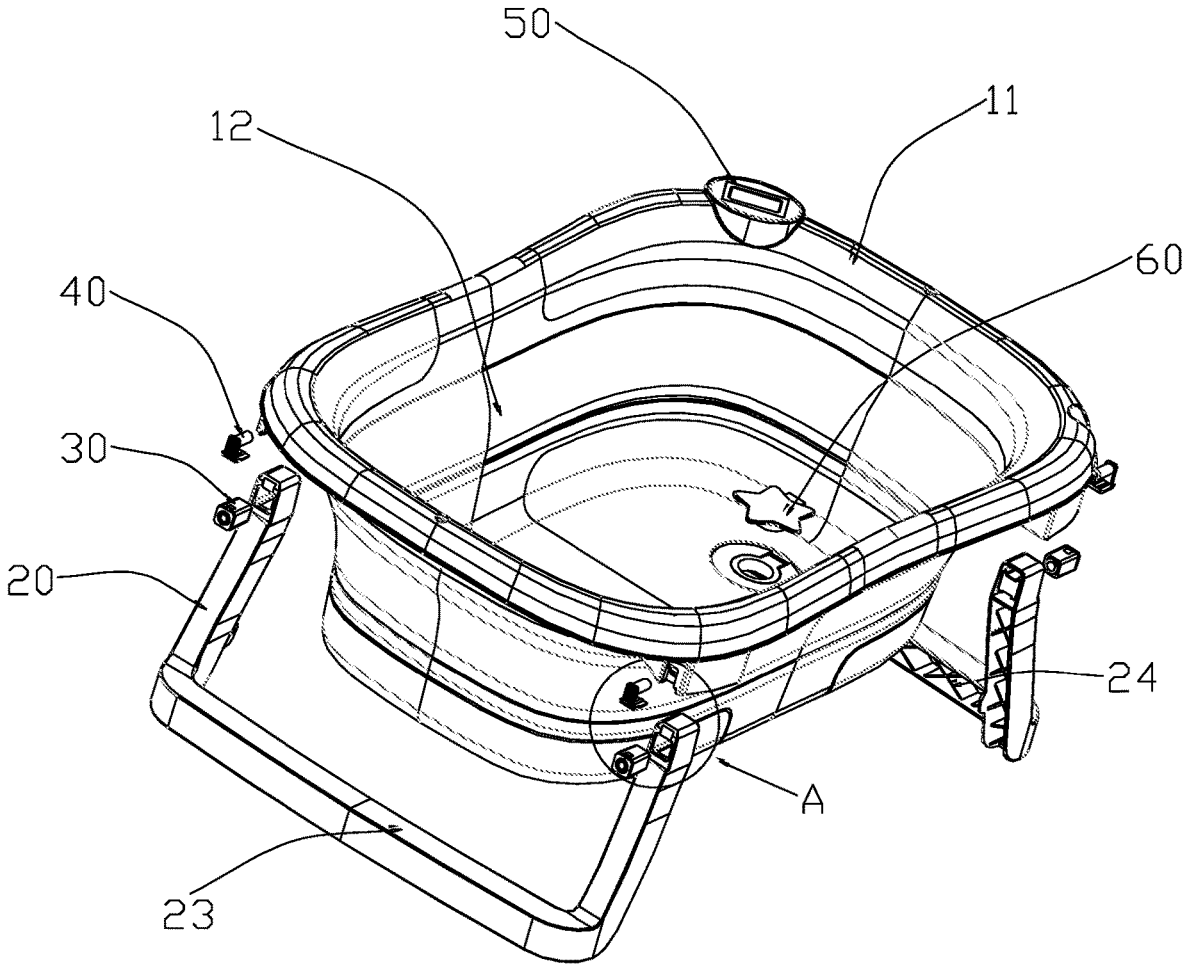
FIG. 3 is a schematic diagram of an exploded structure in one angle of the present disclosure.
Figure 5:
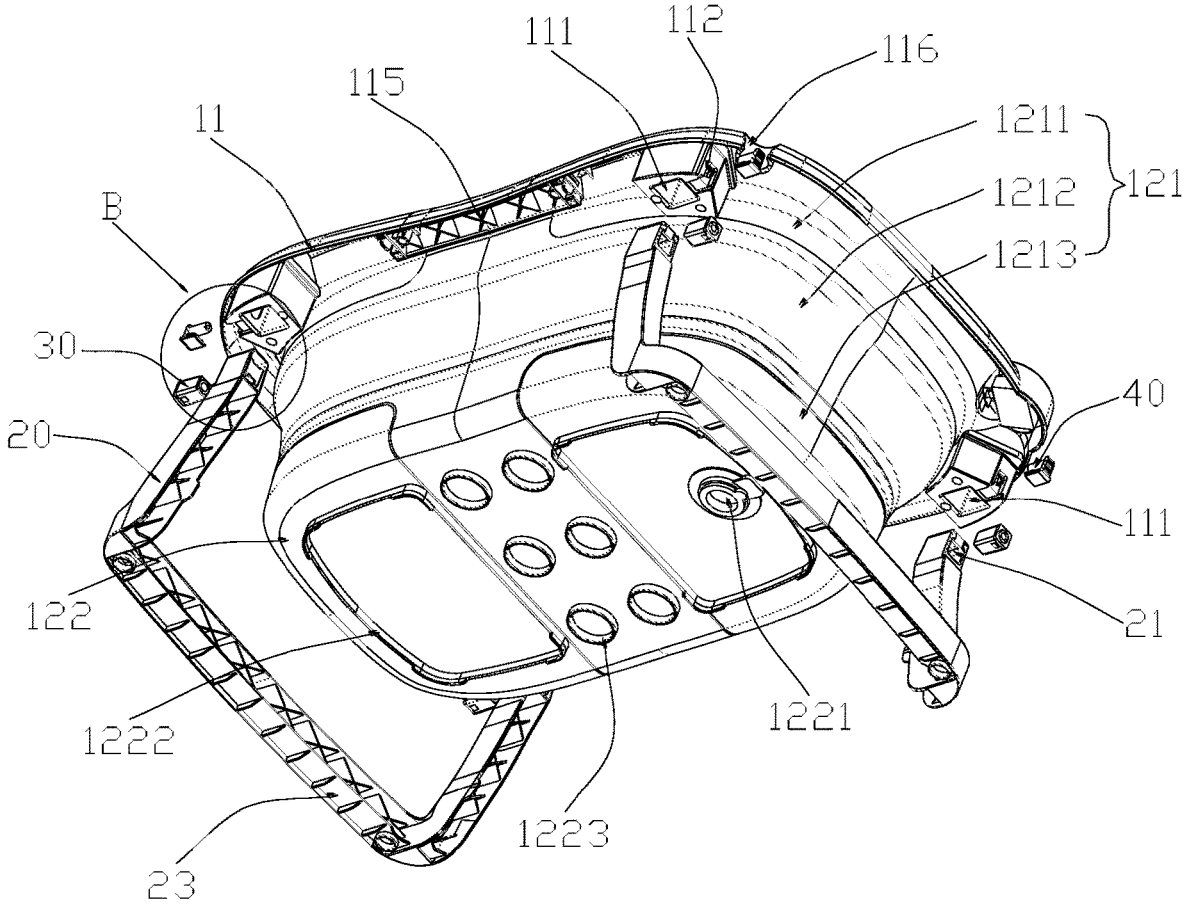
FIG. 5 is a schematic diagram of an exploded structure in another angle of the present disclosure.
Figure 6:
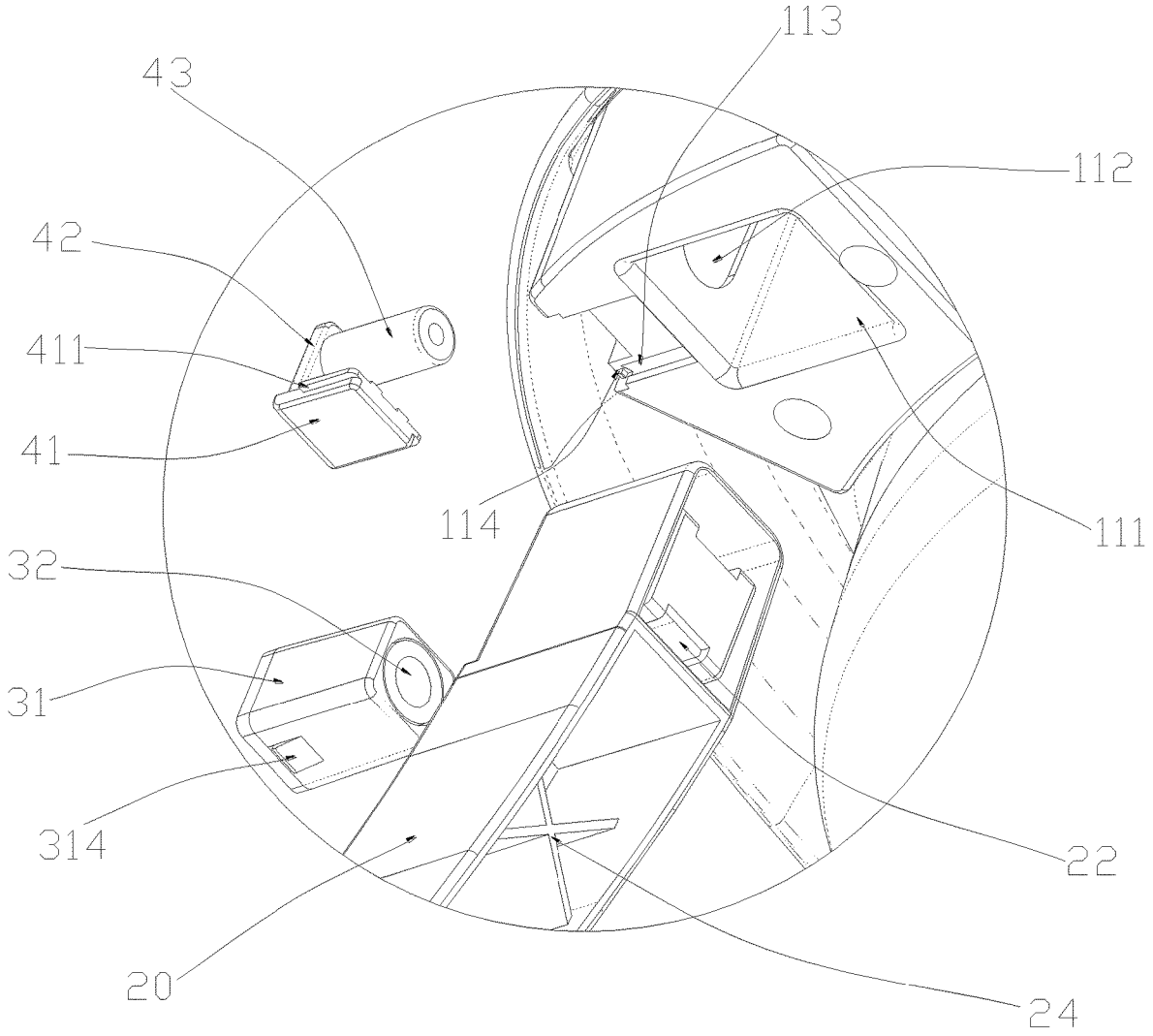
FIG. 6 is an enlarged diagram of a circle B in FIG. 5.
Figure 7:
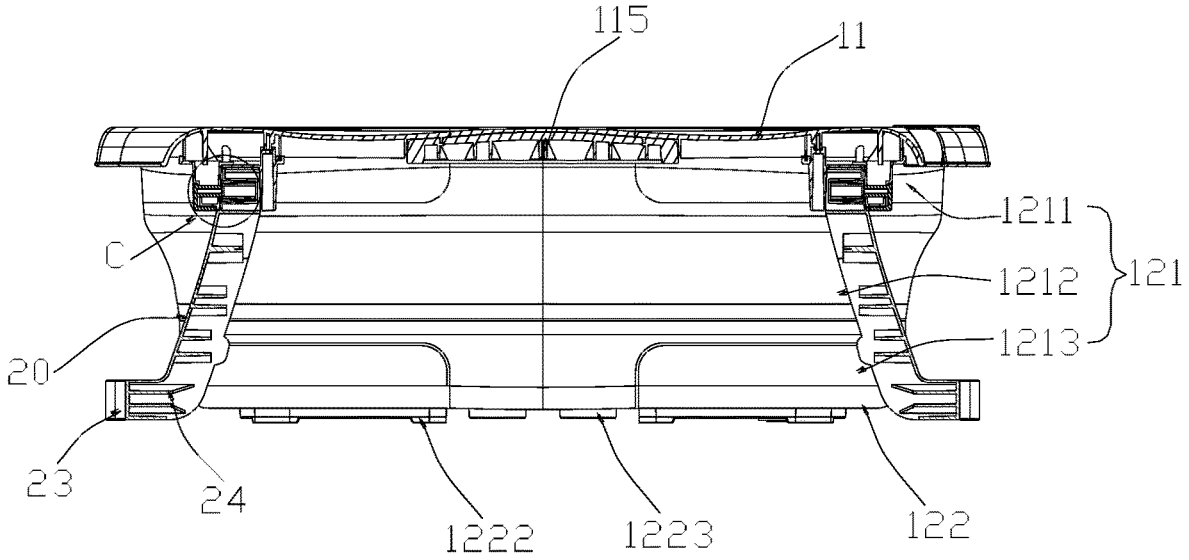
FIG. 7 is a sectional view of the present disclosure.

Referring to FIG. 3 and FIG. 5, in this embodiment, the portable bathtub further includes a drainage valve 60. The bottom wall 122 is provided with a drainage hole 1221, and the drainage valve 60 is plugged into the drainage hole 1221. Based on the setting of the above structure, the user can drain the water in the accommodating portion 12, which facilitates use.

Figure 4:
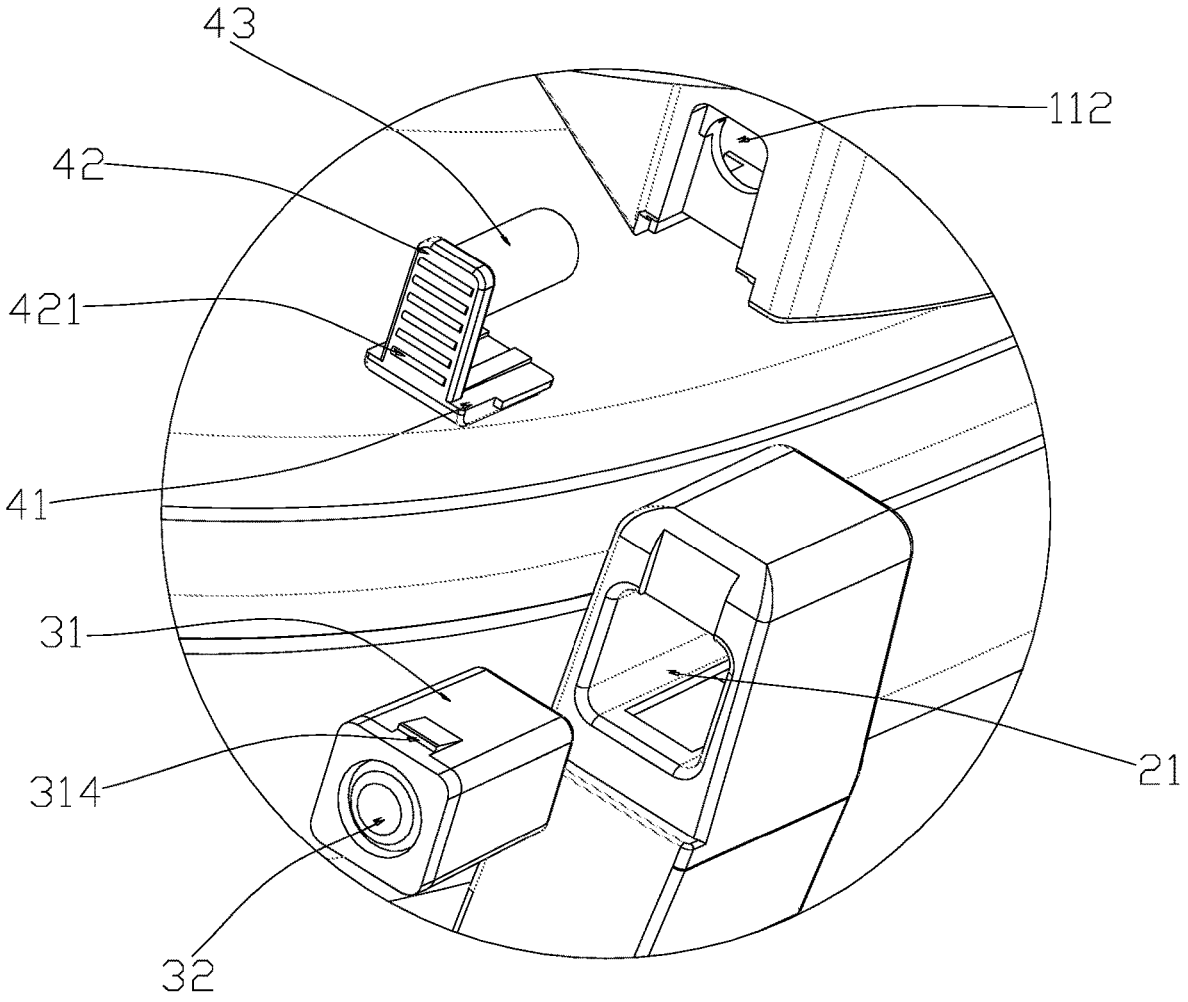
FIG. 4 is an enlarged diagram of a circle A in FIG. 3.

Referring to FIG. 2 and FIG. 4, in this embodiment, the bottom wall 122 is convexly provided with supporting steps 1222 and a supporting ring 1223. The supporting steps 1222 are arranged at two side edges of the bottom wall 122. The supporting ring 1223 is arranged in the middle of the bottom wall 122. Based on the above structural setting, the supporting steps 1222 can effectively increase the height of the product. Furthermore, the majority of the bottom wall 122 is separated from the supporting plane such as the ground, and the supporting steps 1222 are basically arranged at the rigid portion of the bottom wall 122, which reduces a contact area between the bottom wall 122 and the supporting plane such as the ground, prevents a fast decrease in the water temperature in the accommodating portion 12, and ensures the use experience of the user. The majority of the supporting ring 1223 is arranged on the soft portion of the bottom wall 122, which can effectively support the soft portion of the bottom wall 122, prevent the soft portion of the bottom wall 122 from falling, and improve the stability of the product.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A portable bathtub, comprising:

a bathtub main body comprising a framework and an accommodating portion formed by downwards extension of the framework;

locking members; and a supporting member, and the supporting member configured to detachably connect the bathtub main body through the locking members;

wherein the supporting member comprises two supporting legs, each locking member is arranged at a connecting end of each supporting leg, the framework is provided with plugging holes and locking holes communicated to the plugging holes, the locking members are configured to move between locked positions and released positions; the connecting ends of each supporting leg are able to be detachably plugged into respective plugging holes; and when the locking members move to the locked positions, respective locking members are plugged into respective locking holes.

2. The portable bathtub according to claim 1, wherein each locking member comprises a mounting shell, a locking block, and an elastic member; a movement space is arranged in the mounting shell; a mounting slot is formed in the connecting end of each supporting leg; the mounting shell is plugged into the mounting slot; the locking block is slidably arranged in the movement space; one end of the elastic member resists against the locking block; and the other end of the elastic member resists against an inner wall of the mounting slot or an inner wall of the movement space, so that the locking block is plugged into the locking hole.

3. The portable bathtub according to claim 2, wherein the mounting shell is provided with an opening communicated to the movement space; a first limiting step is arranged on an inner wall of the movement space; the locking block is provided with a plugging portion and a sliding portion; a first limiting block is arranged between the plugging portion and the sliding portion; the sliding portion slides in the movement space; the plugging portion passes through the movement space along the opening; and when the locking block is plugged to the locking hole, the first limiting block resists against the first limiting step.

4. The portable bathtub according to claim 3, further comprising actuators, wherein the actuators are slidably arranged on one side of the framework close to the locking holes; the actuators resist against the locking blocks; and the actuators are allowed to be moved by the user to actuate the locking blocks to be removed from the locking holes.

5. The portable bathtub according to claim 4, wherein each actuator comprises a sliding block, a press block, and a resisting block; the sliding block and the resisting block are both connected to the press block; the framework is provided with a sliding rail; the sliding block is slidably arranged in the sliding rail; the press block is allowed to be pressed by the user for actuation; and the resisting block is used for resisting against the locking block to actuate the locking block to be removed from the locking hole.

6. The portable bathtub according to claim 5, wherein third limiting blocks are convexly arranged on two sides of the sliding block; a third limiting step is arranged at an edge of the sliding rail; and the third limiting blocks resist against the third limiting step.

7. The portable bathtub according to claim 5, wherein friction textures are formed on a surface of the press block.

8. The portable bathtub according to claim 2, wherein a second limiting block is arranged on an outer surface of the mounting shell; a second limiting step is arranged on the inner wall of the mounting slot; and when the mounting shell is plugged to the mounting slot, the second limiting block resists against the second limiting step.

9. The portable bathtub according to claim 8, wherein a guide slope is arranged on one side of the second limiting block facing away from the mounting shell; and the guide slope is used for allowing an edge of the second limiting step to slide along the guide slope.

10. The portable bathtub according to claim 9, wherein each supporting leg is further provided with an open slot communicated to the mounting slot; and the open slot is used for allowing a finger of a user to be placed and removing the mounting shell.

11. The portable bathtub according to claim 1, wherein a supporting rod is arranged between free ends of the two supporting legs on one side of the bathtub main body, and the supporting rod is used for being in contact with a supporting plane.

12. The portable bathtub according to claim 1, wherein the supporting legs are provided with first reinforcing ribs; and the framework is rigid, and a lower surface of the framework is provided with a second reinforcing rib.

13. The portable bathtub according to claim 1, further comprising a temperature measuring device, wherein the temperature measuring device is arranged on the framework; and the temperature measuring device is used for measuring a water temperature in the accommodating portion.

14. The portable bathtub according to claim 1, wherein a bayonet is further arranged on an edge of the framework, and the bayonet is used for allowing a shower head to be plugged for use.

15. The portable bathtub according to claim 1, wherein the framework is further provided with a hanging hole, and the hanging hole is used for allowing a hanger to pass.

16. The portable bathtub according to claim 1, wherein the accommodating portion comprises a side wall and a bottom wall; an upper edge of the side wall is connected to a lower edge of the framework; a lower edge of the side wall is connected to a peripheral edge of the bottom wall; at least part of the side wall is elastic; and at least part of the bottom wall is rigid.

17. The portable bathtub according to claim 16, wherein the side wall comprises an upper connecting portion, a deformation portion, and a lower connecting portion; the deformation portion is arranged between the upper connecting portion and the lower connecting portion; the upper connecting portion is connected to the framework; the lower connecting portion is connected to the bottom wall; and the side wall is folded along the deformation portion to reduce a height of the portable bathtub.

18. The portable bathtub according to claim 16, further comprising a drainage valve, wherein the bottom wall is provided with a drainage hole; and the drainage valve is plugged into the drainage hole.

19. The portable bathtub according to claim 16, wherein the bottom wall is convexly provided with supporting steps and a supporting ring; the supporting steps are arranged at two side edges of the bottom wall; and the supporting ring is arranged in the middle of the bottom wall.

* * * * *